US006294861B1

(12) United States Patent
Mochiduki et al.

(10) Patent No.: US 6,294,861 B1
(45) Date of Patent: Sep. 25, 2001

(54) ELECTRIC DISCHARGE LAMP APPARATUS

(75) Inventors: Kunimasa Mochiduki; Masato Harazaki; Yasuyoshi Numajiri; Takeshi Fukuyo; Yoshitaka Ohshima; Shinichi Irisawa, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/201,806

(22) Filed: Dec. 1, 1998

(30) Foreign Application Priority Data

Dec. 8, 1997 (JP) ..... 9-337084

(51) Int. Cl.[7] ..... H01J 5/48; F21M 7/00

(52) U.S. Cl. ..... 313/318.01; 313/318.09; 313/318.1; 439/611

(58) Field of Search ..... 313/318.01, 318.05, 313/318.09, 318.1, 318.06, 318.11, 318.12, 25; 362/285, 288, 311, 369, 396, 255; 439/352, 353, 355, 602, 611

(56) References Cited

U.S. PATENT DOCUMENTS

| | | | | |
|---|---|---|---|---|
| 5,059,855 | | 10/1991 | Irisawa et al. | 313/318 |
| 5,177,397 | | 1/1993 | Nagasawa et al. | 313/318 |
| 5,216,319 | * | 6/1993 | VanHeeswijk | 313/318 |
| 5,250,872 | | 10/1993 | Wakimizu et al. | 313/25 |
| 5,320,562 | | 6/1994 | Moller et al. | 439/613 |
| 5,339,002 | | 8/1994 | Braun et al. | 313/318 |
| 5,627,428 | | 5/1997 | Helbig et al. | 313/318.01 |
| 5,654,608 | * | 8/1997 | Westemeyer et al. | 313/634 |
| 5,736,811 | | 4/1998 | Westemeyer et al. | 313/318.02 |
| 5,742,114 | * | 4/1998 | Kohl et al. | 313/318.01 |
| 5,757,110 | * | 5/1998 | Motiduki et al. | 313/25 |
| 6,031,323 | * | 2/2000 | Behr et al. | 313/318.01 |

FOREIGN PATENT DOCUMENTS

| | | | |
|---|---|---|---|
| 0 570 068 | 11/1993 | (EP) | H01J/61/34 |
| WO 96/35220 | 11/1996 | (WO) | H01J/5/56 |

* cited by examiner

*Primary Examiner*—Michael H. Day
*Assistant Examiner*—Matthew J. Gerike
(74) *Attorney, Agent, or Firm*—Sughrue, Mion, Zinn, Macpeak & Seas, PLLC

(57) ABSTRACT

An electric discharge lamp apparatus which incorporates an arc tube 10 structured such that an enclosed glass bulb 12 of an arc tube body 11 is enclosed in an ultraviolet-ray shielding globe 20 and having a front end which is supported by a metal lead support 36 forwards extending from an insulating plug 30 provided with a focusing ring 34 and made of synthetic resin and which has a structure that a rear end of the globe 20 of the arc tube 10 is supported by a metal support member 50 secured to the insulating plug 30, wherein the metal support member 50 is constituted by a metal base plate 51 secured to the insulating plug 30 and forming a reference plane f2 running parallel to the focusing ring 34 on the front surface of the insulating plug and a metal vertically-holding member 60 (a slide plate 61 and an arc-tube holding band 71) integrally joined to the metal base plate 51 and arranged to vertically hold an electrically-discharge axis L of the held arc tube 10 with respect to reference plane f2 of the metal base plate 51 so that the electrically-discharge axis L of the arc tube 10 is accurately brought to a predetermined required position with respect to the focusing ring 34.

14 Claims, 10 Drawing Sheets

ELECTRIC DISCHARGE LAMP APPARATUS

BACKGROUND OF THE INVENTION

The present invention relates to an electric discharge lamp apparatus having a structure that a front end of an arc tube is supported by a lead support extending from an insulating plug and a rear end of the arc tube is directly supported by the insulating plug. More particularly, the present invention relates to an electric discharge lamp apparatus incorporating an arc tube which has a structure that an ultraviolet-ray-shielding globe for surrounding and enclosing an enclosed glass bulb is integrally welded to the body of an arc tube having an enclosed glass bulb in which electrodes are disposed opposite to each other, and a rear end of the ultraviolet-ray-shielding globe of the arc tube is supported by a metal support member secured to the insulating plug.

As shown in FIG. 15, a conventional electric discharge lamp apparatus has a structure that a pair of long and short lead supports 2*a* and 2*b* projecting over an insulating plug (an insulating base) 1 made of synthetic resin supports the front and rear ends of an arc tube body 5. Electrodes 6 opposite to each other are disposed in an enclosed glass bulb 5*a* of an arc tube body 5. Pinch seal portions 5*b* for sealing molybdenum foil members 7 connected to the electrodes 6 are provided for the enclosed glass bulb 5*a*. Lead wires 8*a* and 8*b* connected to the molybdenum foil members 7 are outwards extended from the pinch seal portions 5*b*. The lead wires 8*a* and 8*b* are, directly or through a metal support member 9, secured to lead supports 2*a* and 2*b* by welding, the lead supports 2*a* and 2*b* being passages for electric power.

The enclosed glass bulb 5*a* includes metal halide, for example, a sodium-thallium-indium material or a scandium-sodium material. An ultraviolet-ray shielding globe 3 is secured and held by the insulating plug 1 such that the globe 3 surrounds the enclosed glass 5*a* of the arc tube. The globe 3 cuts ultraviolet rays in wavelength regions of light emitted from the arc tube body 5 which are harmful to the human body or elements constituting the lamp.

However, the metal lead supports 2*a* and 2*b* disposed in the ultraviolet-ray shielding globe 3 are exposed to ultraviolet rays emitted in the electric discharge portion of the arc tube. Thus, free electrons having negative electric charges are excited and discharged from the inside portion of the lead support. When the free electrons reach the portion in the vicinity of the outer surface of the enclosed glass bulb 5*a*, metal atoms (Na+) having positive electric charges in the enclosed glass bulb 5*a* are pulled by the free electrons having the positive electric charges, and then allowed to pass through the wall of the glass bulb. Thus, the metal atoms are discharged to the outside of the glass bulb. As a result, the steam pressure of light emitting substances in the enclosed glass bulb 5*a* is lowered. Thus, there arises a problem in that the lifetime of the arc tube is shortened.

Accordingly, an electric discharge lamp apparatus has been suggested which has a structure as shown in FIG. 16 such that the arc tube incorporates the arc tube body 5 to which the ultraviolet-ray shielding globe 3 is integrally welded so as to surround and enclose the enclosed glass bulb 5*a*. Moreover, the front surface of the insulating plug 1 directly supports the rear end of the arc tube and the outer surface of the globe 3.

A dish-shape disc 4 made of ceramics is secured to the front end of the insulating plug 1 with screws. The rear end of the arc tube penetrates an arc-tube insertion hole 4*a* formed in the disc 4 so as to be engaged to an engaging hole la formed in the insulating plug 1. Moreover, the globe 3 is held by an inorganic bond layer 4*b* injected into the disc 4. A screw 4*c* secures the disc 4 to the insulating plug 1. A focusing ring 1*b* integrally secures to the outer surface of the insulating plug 1.

The ultraviolet-ray shielding globe 3 cuts ultraviolet rays of light emitted by the enclosed glass bulb 5*a* in the wavelength regions harmful to the human bodies and the elements constituting the lamp. Therefore, an adverse influence on the human body and the elements constituting the lamp can be eliminated. Moreover, the problem can be prevented which has been experienced with the conventional structure in that free electrons are discharged from the lead support exposed to the ultraviolet rays and thus excited, and, therefore, the steam pressure of the light emitting substances in the enclosed glass bulb 5*a* is lowered. In FIG. 16, the same elements as those shown in FIG. 15 are given the same reference numerals and the same elements are omitted from description.

The electric discharge lamp apparatus shown in FIG. 16 has the structure that the rear end of the arc tube is supported by the disc 4 secured to the front surface of the insulating plug 1. However, inclination of the arc tube with respect to the disc 4 is substantially inhibited. Therefore, an axis (hereinafter called a "discharge axis") L connecting the opposite electrodes 6 of the arc tube to each other cannot accurately be positioned with respect to the disc 4. Since the ceramic disc 4 integrating the arc tube is secured to the insulating plug 1 with the screws 4*c*, the positions of the disc 4 and the insulating plug 1 cannot be adjusted in the radial direction. Therefore, the conventional technique encounters a difficulty in accurately positioning the discharge axis L of the arc tube with respect to the central axis of the focusing ring 1*b*.

SUMMARY OF THE INVENTION

In view of the foregoing, an object of the present invention is to provide an electric discharge lamp apparatus which is capable of easily and accurately position the electric discharge axis of an arc tube thereof with respect to the central axis of a focusing ring.

To achieve the above-mentioned object, according to a first aspect of the present invention, there is provided an electric discharge lamp apparatus comprising: an arc tube having a glass bulb, electrodes being opposite to each other, an ultraviolet-ray shielding globe for surrounding and shielding the glass bulb; an insulating plug having a focusing ring, wherein the insulating plug made of synthetic resin; a metal lead support forwardly extending over the insulating plug, for supporting a front end of the arc tube; and a metal support member secured to the insulating plug and arranged to support a portion of the arc tube adjacent to a rear end of the globe, wherein the metal support member includes, a metal base plate secured to the insulating plug and forming a reference plane running parallel to the focusing ring, and a vertically-holding member made of metal, joined integrally with the metal base plate and vertically holding an electrically-discharging axis of the arc tube with respect to the reference plane of the metal base plate.

The base plate has the reference plane which runs parallel to the focusing ring, which is a reference member for performing positioning with respect to the reflector. The electric discharge axis of the arc tube is, by the vertically-holding member made of metal, held vertically with respect to the reference plane of the base plate. Therefore, movement of the vertically-holding member which is holding the arc tube, along the reference plane of the base plate enables the electrically-discharging axis to be positioned to a predetermined required position (to a position on the central axis of the electric discharge lamp apparatus) with respect to the focusing ring.

That is, when the vertically-holding member which is holding the arc tube is moved along the base plate until the electrically-discharging axis coincides with the central axis of the electric discharge lamp apparatus, the vertically-holding member is joined and integrated with the base plate. Thus, the electrically-discharging axis can be brought to a predetermined required position with respect to the focusing ring.

According to a second aspect of the invention, there is provided the electric discharge lamp apparatus of the first aspect, wherein the vertically-holding member comprises: an arc-tube holding band made of metal and wound around and sectured to the globe of the arc tube; and a ring-shape and metal slide plate arranged to hold an outer surface of the arc-tube holding band, having a plurality of tag shape holding members arranged to be welded to the arc-tube holding band in the holding portion and integrally welded to the metal base plate, wherein the arc-tube holding band wound around and secured to the arc tube and the slide plate are integrated such manner that the electrically-discharge axis of the arc tube is perpendicular to a joining surface between the slide plate and the metal base plate.

The arc tube is secured and integrated with the vertically-holding member by welding the tag shape holding members to the holding band wound around the globe of the arc tube so as to be secured. Before the tag shape holding members are welded to the holding band, the arc tube around which the holding band has been wound can be slid in the axial direction with respect to the tag shape holding members or inclined with respect to the holding portion. Moreover, the slid or inclined attitude of the arc tube can be maintained. That is, the attitude of the arc tube can freely be changed. Therefore, the arc tube is slid or inclined to move the center between the electrode to a predetermined height from the slide plate and to make the electrically-discharging axis to be in parallel to the vertical reference axis (the reference axis of the slide plate perpendicular to the joining surface of the base plate). Then, the tag shape holding members are welded so as to be secured to the holding band. Thus, the electrically-discharging axis can be positioned perpendicular to the slide plate. The slide plate (the vertically-holding member) with which the arc tube has been integrated is moved (slid) along the (reference plane) of the base plate. At a position at which the electrically-discharging axis has coincided with the central axis (the central axis of the focusing ring) of the electric discharge lamp apparatus, the slide plate is, by welding, integrated with the base plate. Thus, the electrically-discharging axis of the arc tube integrated with the insulating plug through the vertically-holding member is positioned at a required position with respect to the focusing ring.

According to a third aspect of the invention, there is provided the electric discharge lamp apparatus of the first aspect, wherein the metal base plate is integrally secured to the insulating plug by integral molding, and the metal base plate has a folded portion which is embedded in the insulating plug to serve as a separation stopper.

Therefore, separation of the folded portion of the base plate in the insulating plug is prevented so that the separation of the base plate from the insulating plug is prevented. As a result, rattle of the arc tube supported by the vertically-holding member with respect to the insulating plug can be prevented.

According to a fourth aspect of the invention, the electric discharge lamp apparatus of the second aspects wherein the arc-tube holding band has rectangular tag members folded to have an S-shape cross sectional shape to face each other, the tag members allowed to abut against each other are welded to each other to fixedly wind the arc-tube holding band around the globe of the arc tube, and a side end of each of the tag members each facing the slide plate is cut into a tapered shape.

To vertically position the electrically-discharging axis of the arc tube with respect to the slide plate, the inclination of the arc tube with respect to the slide plate must be adjusted. When the inclination of the arc tube is adjusted, there is apprehension that the tag shape members of the holding band which outwardly projects over the arc tube interfere with the slide plate. Since the side end of each tag shape member facing the slide plate is cut into the tapered shape, interference between the tag shape members and the slide plate can be prevented even if the arc tube is greatly inclined.

According to a fifth aspect of the invention, the electric discharge lamp apparatus of the first aspect, wherein the insulating plug includes: a cylindrical outer tube extending rearwards at the rear end of the insulating plug; a cylindrical boss formed in the outer tube and extending rearwards; a belt-type terminal to which the lead support is welded, being secured to the outer tube, wherein the belt-type terminal is in the form of a cylindrical member having an outward flange provided with a lead-support insertion hole and a cut portion for locating the circumferential direction; a cap-type terminal to which a lead wire extending from the rear end of the arc tube and allowed to penetrate the insulating plug is welded, being fitted to the boss, wherein the belt-type terminal is formed integrally with the insulating plug by insertion molding; and a lamp-side connector formed integrally with the rear end of the insulating plug, for connecting a connector for supplying electric power.

The structure causes the belt-type terminal to be integrated with the insulating plug simultaneously with the process (for example, the injection molding process) for molding the insulating plug. Therefore, the process for joining the belt-type terminal to the insulating plug can be omitted.

Since the lead support is welded and secured to the lead-support insertion hole formed in the outward flange, the cylindrical member having the outward flange must be positioned in the circumferential direction of the portion of the insulating plug for joining the belt-type terminal. The cut portion provided for the outward flange can be used in the positioning process.

According to a sixth aspect of the invention, there is provided the electric discharge lamp apparatus of the first aspect, wherein the insulating plug comprises: a cylindrical outer tube extending rearwards at the rear end of the insulating plug; a cylindrical boss formed in the outer tube and extending rearwards at the rear end of the insulating plug; a belt-type terminal to which the lead support is welded, being secured to the outer tube; a cap-type terminal to which a lead wire extending from the rear end of the arc tube and allowed to penetrate said insulating plug is welded, being fitted to the boss; a lamp-side connector formed integrally with the rear end of the insulating plug, for connecting a connector for supplying electric power; and a vertical rib for preventing separation of the fitted cap-type terminal is provided for the outer surface of the boss.

The structure incorporates the vertical rib provided for the outer surface of the boss enlarges the adhesive force (the contact force in the radial direction) of the cap-type terminal fitted to the boss. As a result, separation of the cap-type terminal from the boss can be prevented.

BRIEF DESCRIPTION OF THE DRAWINGS

FIG. 12(*b*) is a diagram showing a process for joining the arc tube to the slide plate;

FIG. 12(*c*) is a diagram showing a process for positioning and securing the slide plate, to which the arc tube is integrated, to the base plate;

DETAILED DESCRIPTION OF THE PREFERRED EMBODIMENTS

An embodiment of the present invention will now be described.

Figure 1:
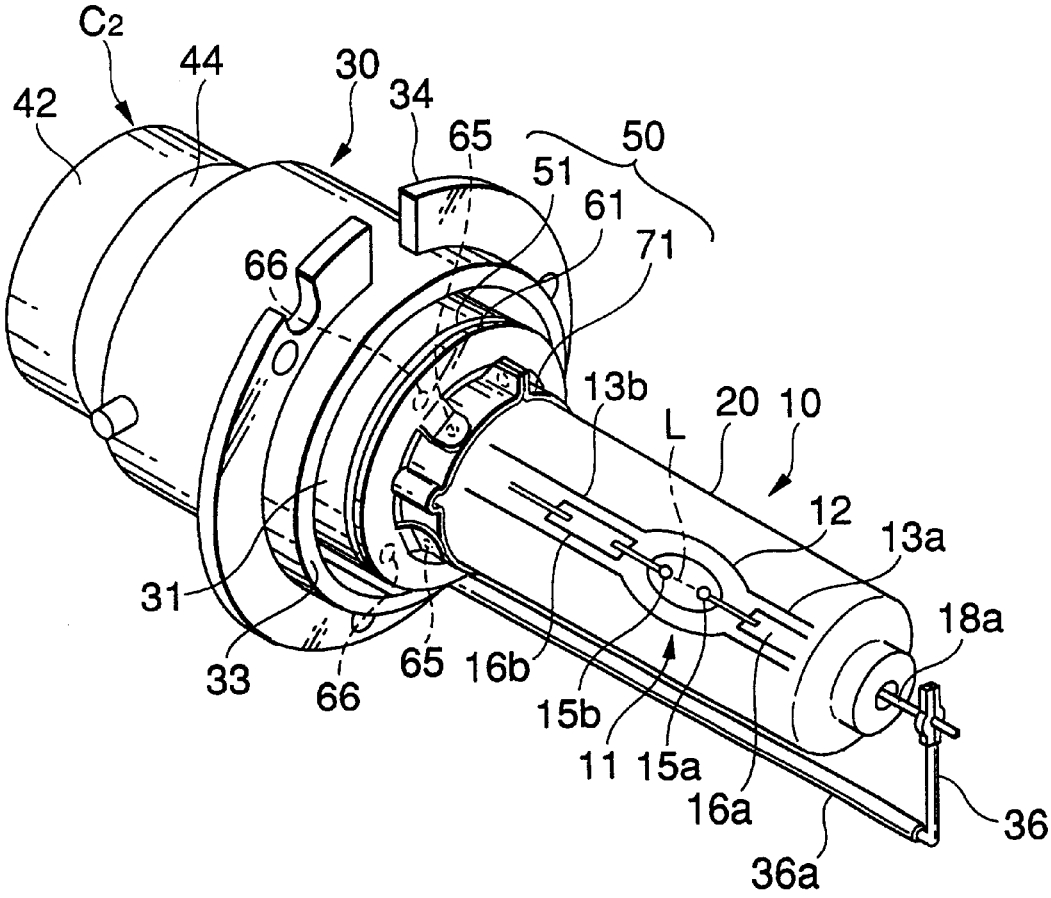
FIG. 1 is a perspective view showing an electric discharge lamp apparatus according to a first embodiment of the present invention.
Figure 2:
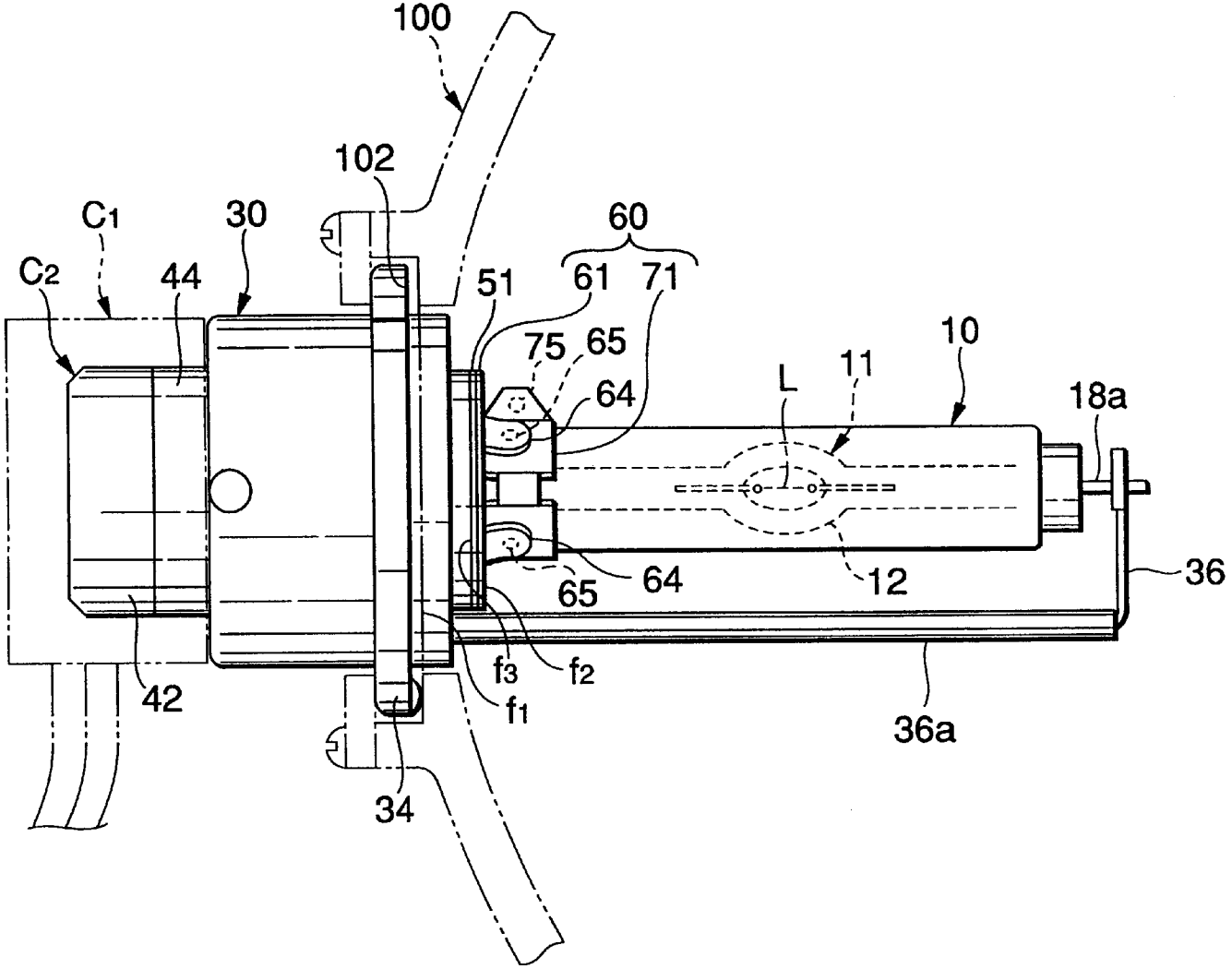
FIG. 2 is a side view showing the electric discharge lamp apparatus.
Figure 3:
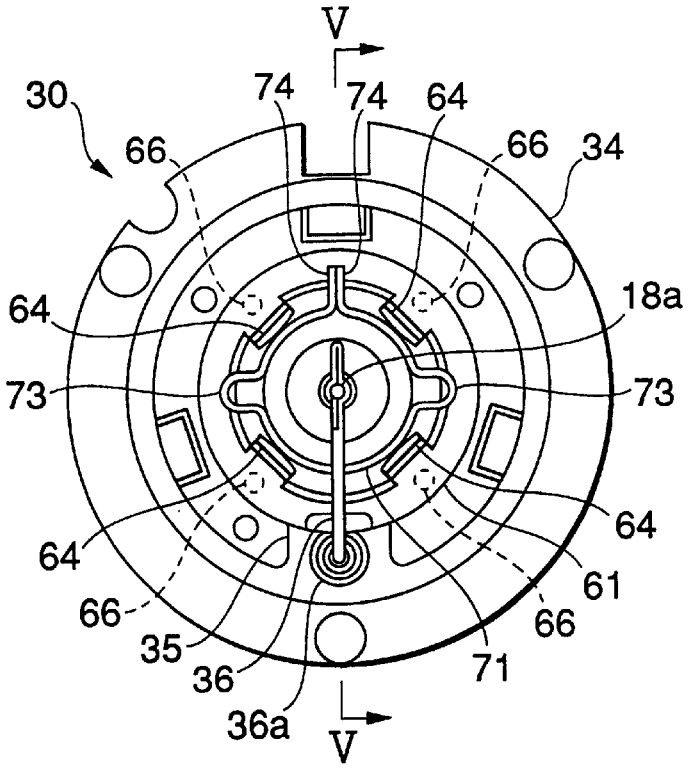
FIG. 3 is a front view showing the electric discharge lamp apparatus.
Figure 4:
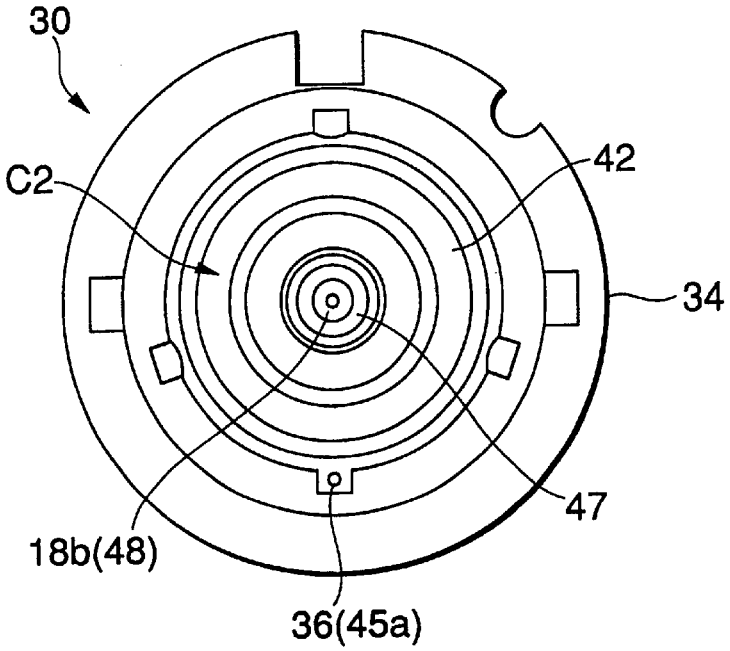
FIG. 4 is a rear view showing the electric discharge lamp apparatus.
Figure 5:
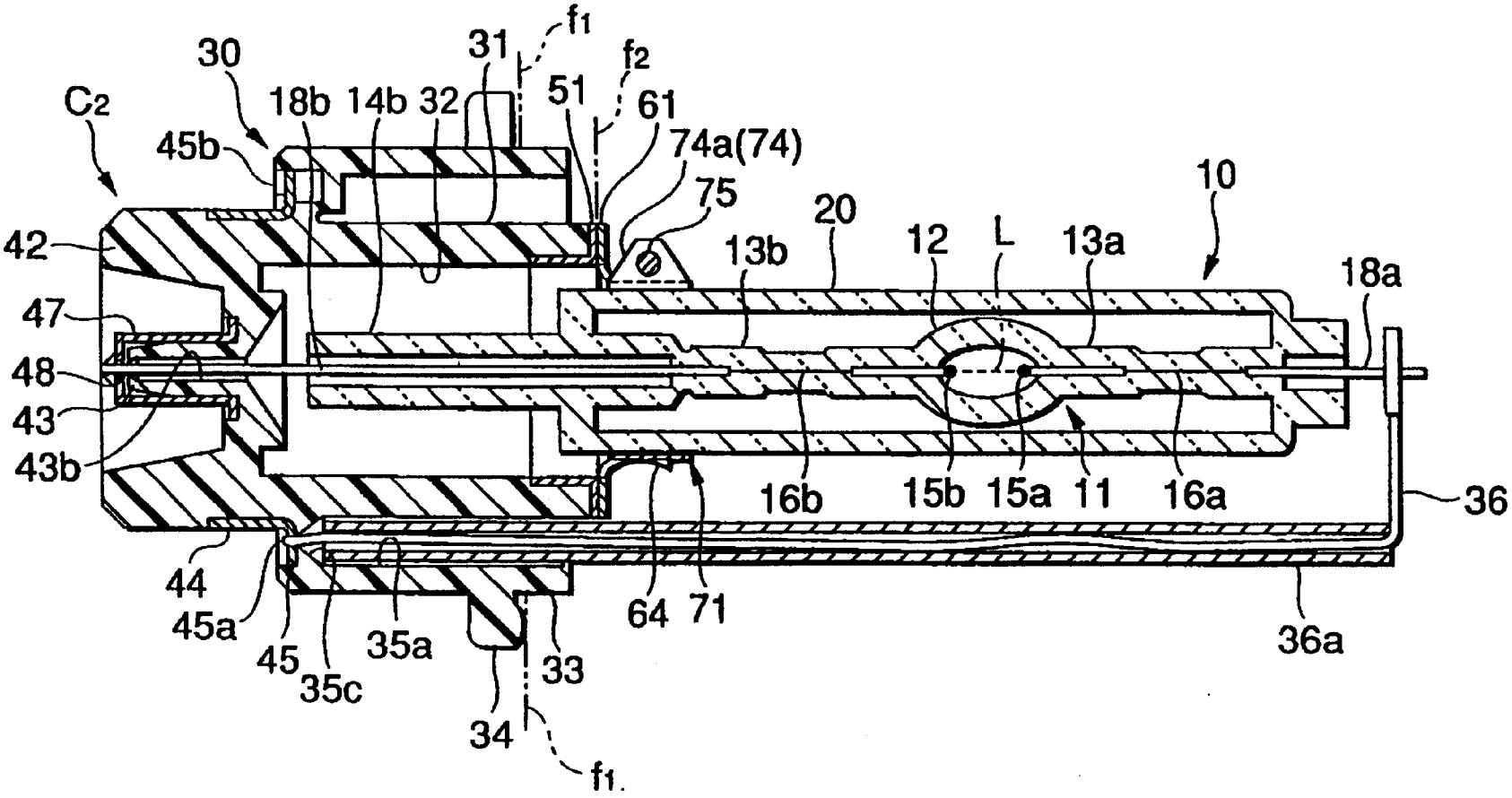
FIG. 5 is a vertical cross sectional view (a cross sectional view taken along line V—V shown in FIG. 3) showing the electric discharge lamp apparatus.
Figure 6:
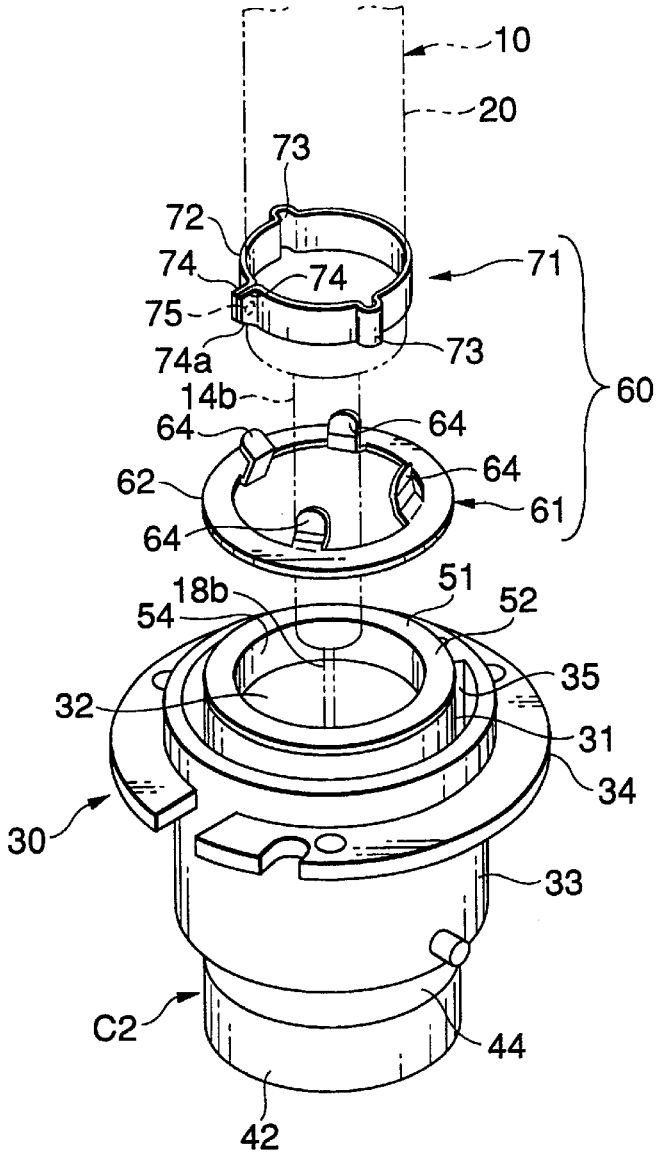
FIG. 6 is an exploded perspective view showing a vertically-holding member for holding an arc tube.
Figure 7:
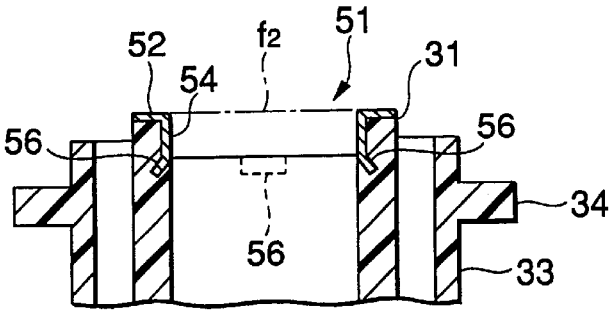
FIG. 7 is a vertical cross sectional view showing the front portion of an insulating plug to which a base plate is integrally secured.
Figure 8:
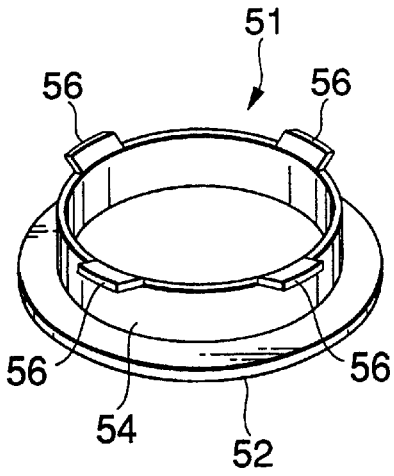
FIG. 8 is a rear perspective view showing the base plate.
Figure 9:
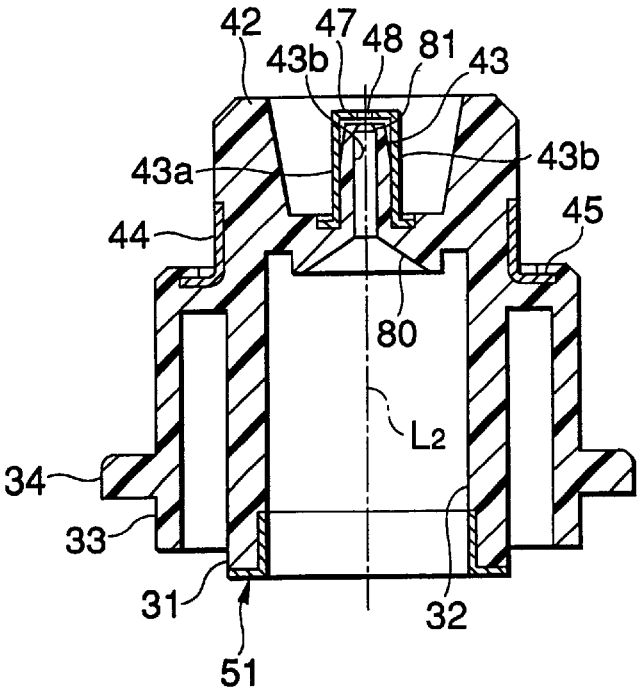
FIG. 9 is a vertical cross sectional view showing the insulating plug having a rear end facing upwards.
Figure 10:
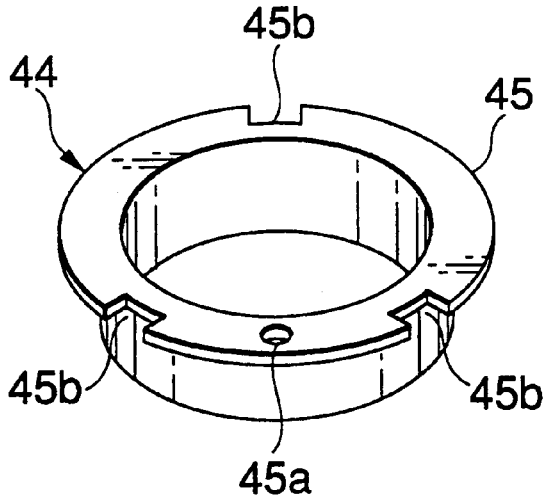
FIG. 10 is a rear perspective view showing a belt-type terminal.
Figure 11:
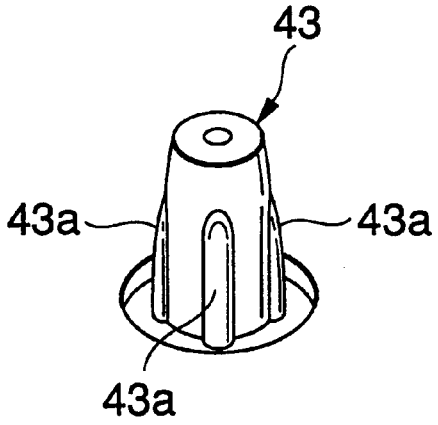
FIG. 11 is a perspective view showing a boss to which the cap-type terminal is fitted.
Figure 12A:
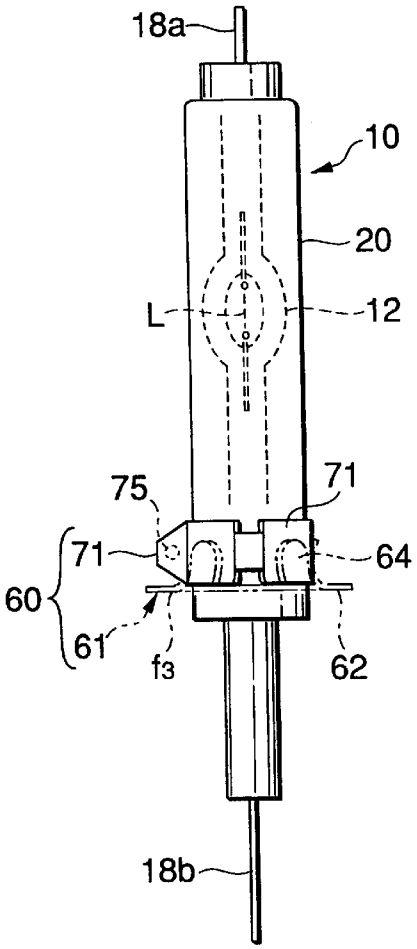
FIG. 12(*a*) is a diagram showing a process for joining the arc tube to a slide plate.
Figure 12B:
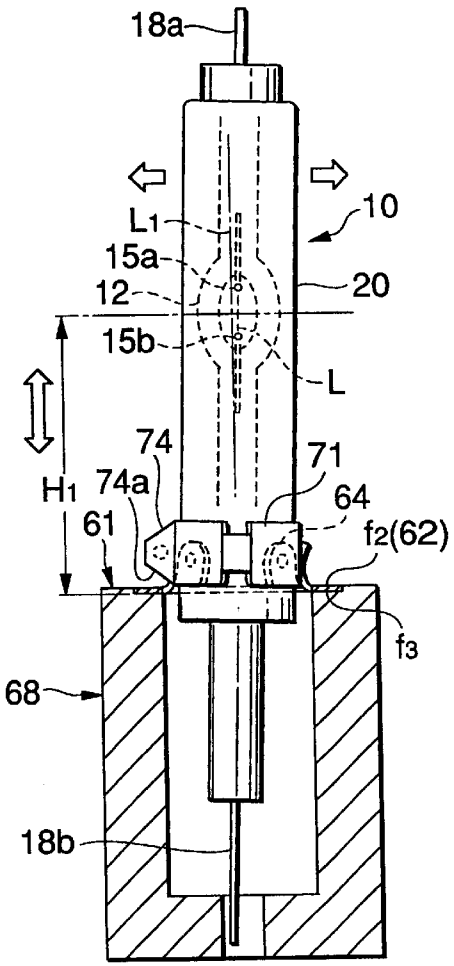
Figure 12C:
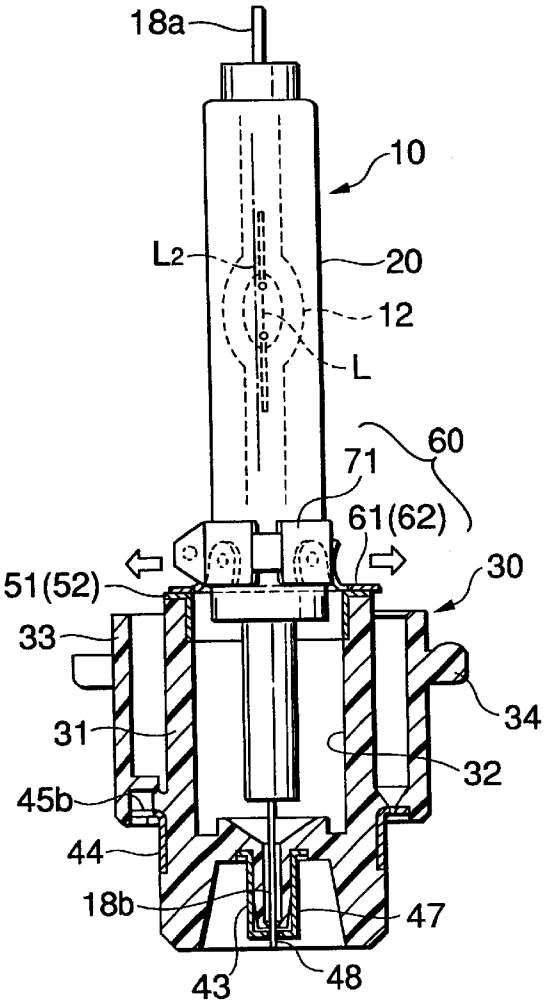
Figure 13:
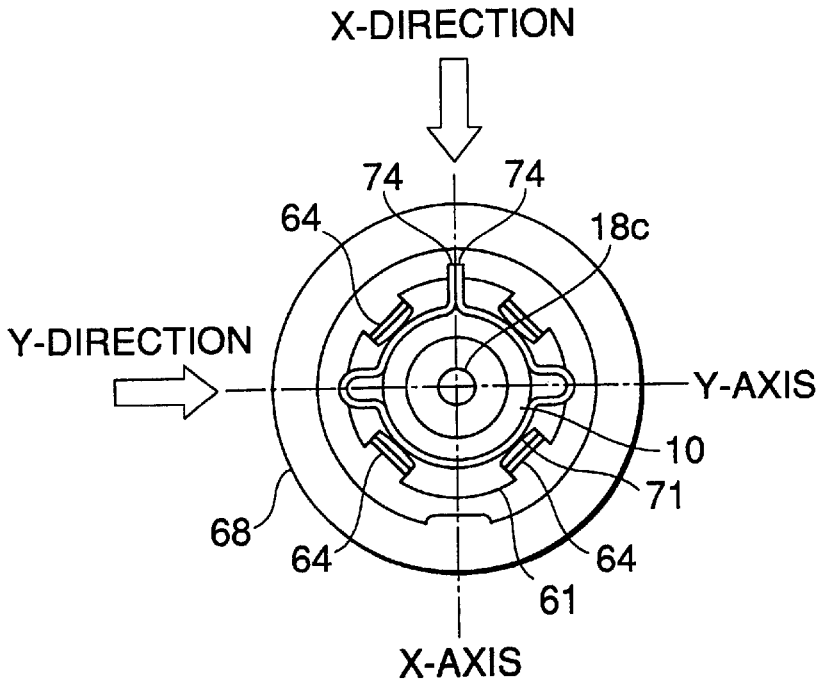
FIG. 13 is a plan view showing a state in which the arc tube is positioned with respect to the slide plate.
Figure 14:
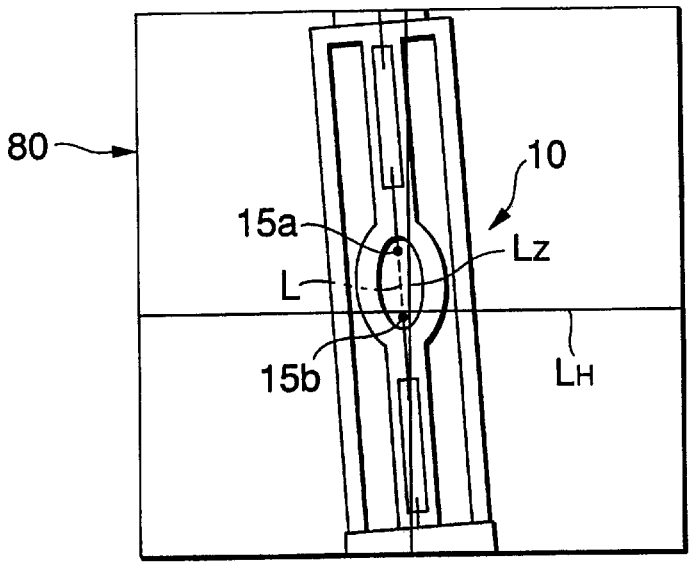
FIG. 14 is a diagram showing an image on a display unit when the arc tube is observed with a CCD camera from the direction X.
Figure 15:
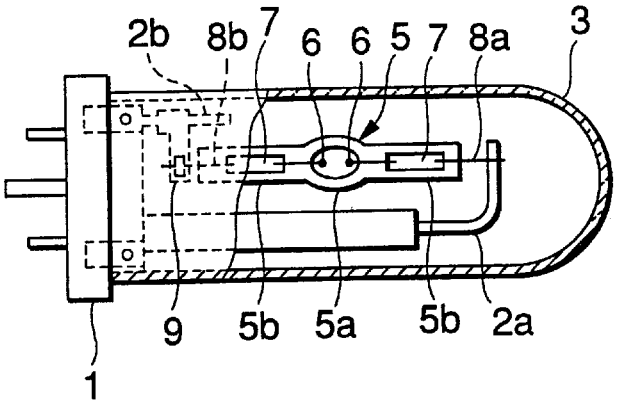
FIG.15 Conventional Art
FIG. 15 is a vertical cross sectional view showing a conventional electric discharge lamp apparatus.
Figure 16:
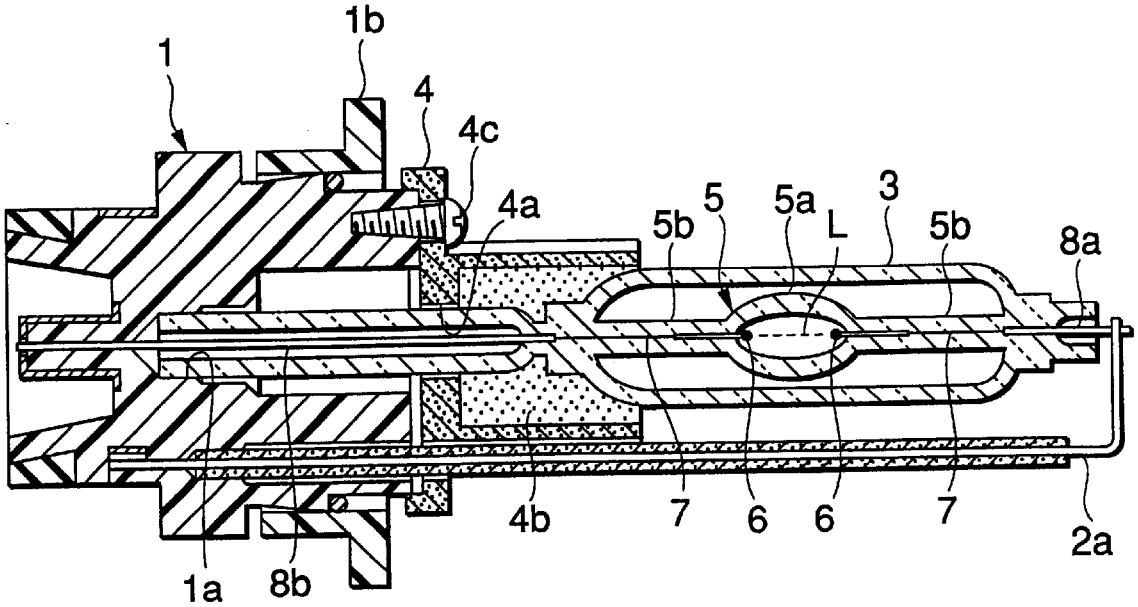
FIG.16 Conventional Art
FIG. 16 is a vertical cross sectional view showing another conventional electric discharge lamp apparatus.

FIGS. 1 to 14 show a first embodiment of the present invention. FIG. 1 is a perspective view showing an electric discharge lamp apparatus according to a first embodiment of the present invention. FIG. 2 is a side view showing the electric discharge lamp apparatus. FIG. 3 is a front view showing the electric discharge lamp apparatus. FIG. 4 is a rear view showing the electric discharge lamp apparatus. FIG. 5 is a vertical cross sectional view (a cross sectional view taken along line V—V shown in FIG. 3) showing the electric discharge lamp apparatus. FIG. 6 is an exploded perspective view showing a vertically-holding member for holding an arc tube. FIG. 7 is a vertical cross sectional view showing the front end of an insulating plug having a base plate secured and integrated thereto. FIG. 8 is a rear perspective view showing the base plate. FIG. 9 is a vertical cross sectional view showing an insulating plug having a rear end facing upwards. FIG. 10 is a rear perspective view showing a belt-type terminal. FIG. 11 is a perspective view showing a boss to which a cap-type terminal is fitted. FIG. 12 is a diagram showing a process for joining the arc tube to the insulating plug, in which FIG. 12(*a*) is a diagram showing a process for joining the arc tube to the slide plate, FIG. 12(*b*) is a diagram showing a process for positioning and securing the arc tube to the slide plate and FIG. 12(*c*) is a diagram showing a process for positioning and securing the slide plate, with which the arc tube has been integrated, to the slide plate. FIG. 13 is a plan view showing a process for positioning the arc tube to the slide plate. FIG. 14 is a diagram showing an image displayed on a display unit when the arc tube is viewed with a CCD camera from the direction X.

An insulating plug 30 is made of synthetic resin and incorporating a lamp-side connector C2 which can be connected to a connector C1 (see FIG. 2) for supplying electric power and which is integrally formed at the rear end thereof. The insulating plug 30 has a focusing ring 34 disposed on the outer surface thereof, the focusing ring 34 defining a contact reference plane f1 (see FIGS. 2 and 5) which is engaged to a bulb insertion hole 102 (see FIG. 2) of a reflector 100 of a headlamp for a vehicle. In front of the insulating plug 30, an arc tube 10 is secured and supported by a lead support 36 made of a metal material and extending forwards over the plug 30 and a metal support member 50 secured to the front surface of the plug 30. Thus, the electric discharge lamp apparatus is constituted.

That is, a lead wire 18*a* extending from the front end of the arc tube 10 is, by spot welding, secured to a folded leading end of a lead support 36 extending from the insulating plug 30. Moreover, a trailing end of the arc tube 10 is held by a metal support member 50 comprising of a metal base plate 51 secured to the front surface of the insulating plug 30, a slide plate 61 and an arc-tube holding band 71.

Note that the arc tube 10 has a structure that a cylindrical ultraviolet-ray shielding globe 20 is welded and hermetically joined to an arc tube body 11 having an enclosed glass bulb 12 in which tungsten electrodes 15*a* and 15*b* are disposed opposite to each other. Thus, the enclosed glass bulb 12 is surrounded by the ultraviolet-ray shielding globe 20. Symbol L represents an electrically-discharging axis which connects the tungsten electrodes 15*a* and 15*b* to each other.

The arc tube body 11 has a structure in which the enclosed glass bulb 12 which has been manufactured from a quartz glass pipe in the form of a cylindrical pipe, which is formed at a predetermined position in the lengthwise direction and which has a rotative elliptic shape interposed between pinch seal portions 13*a* and 13*b* each having a rectangular cross sectional shape. In the glass bulb 12, starting rare gas, mercury and a metal halide, for example, a sodium-scandium type light emitting substance, are enclosed. In the pinch seal portions 13*a* and 13*b*, rectangular molybdenum foil members 16*a* and 16*b* are bonded. Tungsten electrodes 15*a* and 15*b* disposed opposite to each other in the enclosed glass bulb 12 are connected to either of the molybdenum foil members 16*a* and 16*b*, while lead wires 18*a* and 18*b* extending to the outside of the arc tube body 11 are connected to the other one of the tungsten electrodes 15*a* and 15*b*.

A cylindrical ultraviolet-ray shielding globe 20 having an inner diameter larger than the diameter of the enclosed glass bulb 12 is integrally welded to the arc tube body 11. Thus, regions of the arc tube body 11 from the pinch seal portions 13*a* and 13*b* to the enclosed glass bulb 12 are enclosed and hermetically sealed by the ultraviolet-ray shielding globe 20. Moreover, a rearwardly-extending portion 14*b* (see FIG. 5) which is a non pinch seal portion of the arc tube body 11 and which is formed into a cylindrical pipe projects over the rear end of the globe 20. Note that the length from the leading end of the arc tube to the rear end of the globe 20 is 46 mm. Moreover, the length of the rearwardly-extending portion 14*b* projecting over the rear end of the globe 20 is 15 mm.

The globe 20 is made of quartz glass to which $TiO_2$ and $CeO_2$ have been doped and which has an ultraviolet ray shielding action so as to reliably cut ultraviolet rays of light in a predetermined wavelength region harmful to the human body, light being light emitted by the enclosed glass bulb 12 serving as an electric discharge portion. The inside portion of the globe 20 is made to be a vacuum state or a state in which inactive gas has been enclosed. Thus, the globe 20 has a heating insulating action for insulating heat radiated from the enclosed glass bulb 12 which is the electric discharge portion. As a result, the design is prepared in such a manner that the characteristics of the lamp are not affected by change in the external environment.

Therefore, the metal members, such as the lead support 36 and the slide plate 61 are irradiated with light from which the ultraviolet rays in a predetermined wavelength region has been cut. Thus, the quantity of free electrons which are excited and thus discharged to the outside of the metal members can be reduced. As a result, the problem in that the steam pressure of the light emitting substance in the enclosed glass bulb 12 is reduced can be prevented.

As shown in FIG. 9, a cylindrical inner tube portion 31 having an opening 32 through which the rearwardly-extending portion 14*b* of the arc tube 10 can be inserted so as to be accommodated is formed in front of the insulating plug 30. A cylindrical outer tube portion 33 having the focusing ring 34 formed at the periphery thereof is formed around the inner tube portion 31 except for a bridge portion 35 (see FIGS. 3 and 6) having a lead-support insertion hole 35*a* formed therein. A ceramic insulating sleeve 36*a*, into which a lead support 36 has been inserted, is inserted into the lead-support insertion hole 35*a*. The rear end of the lead support 36 which has penetrated the insulating sleeve 36*a* rearwards projects over a tapered hole 35*c* (see FIG. 5) opened at the rear of the insulating plug 30. The foregoing rear end is inserted into a lead-support engaging hole 45*a* of a belt-type terminal 44 provided for the rear end portion of the insulating plug 30 so as to be laser-welded to the lead-support engaging hole 45*a*.

A metal base plate 51 is hermetically secured to the front end of the cylindrical tube portion 31. As shown in FIGS. 7 and 8 in the form of enlarged views, the base plate 51 has a shape that a cylindrical portion 54 is formed at the inner end of an annular substrate 52. By insertion molding which is injection molding which is performed such that the base plate 51 is inserted into a mold, the base plate 51 is integrated with the insulating plug 30 in a state in which the annular substrate 52 is exposed. Four folded portions 56 folded outwards are formed at the same intervals in the circumferential direction of the leading end of the cylindrical portion 54. The folded portions 56 are embedded in the cylindrical tube portion 31 of the insulating plug 30 to serve as separation stoppers. Thus, the base plate 51 is firmly secured and integrated with the cylindrical tube portion 31. Therefore, there is no risk of the separation, for example, exfoliation, of the base plate 51 from the insulating plug 30.

The front surface of the annular substrate 52 of the base plate 51 integrated with the insulating plug 30 is formed into a reference plane f2 (see FIGS. 5 and 7) running parallel to a reference plane f1 (see FIGS. 2 and 5) of the focusing ring 34 which is a positioning reference member with respect to the reflector 100. A metal vertically-holding member 60 is joined and secured to the upper surface of a base portion 52 of the base plate 51, the vertically-holding member 60 being composed of a metal slide plate 61 and an arc-tube holding band 71 made of a metal material. The vertically-holding member 60 is arranged to vertically hold the globe 20 of the arc tube 10. An electrically-discharge axis L of the arc tube 10 is positioned on a predetermined position on the central axis L2 (refer to FIGS. 9 and 12 (*c*)) of the focusing ring 34.

That is, as shown in FIG. 6, the arc-tube holding band 71 of the vertically-holding member 60 has rectangular tag shape members 74 each of which is folded to have an L-shape cross sectional shape and formed at each of the two butting portions of an elongated band body 72. When the tag shape members 74 of the band body 72 wound around the globe 20 of the arc tube 10 are caused to abut against each other so as to be spot-welded at a spot welding poariotn 75, the arc-tube holding band 71 can be wound around the globe 20 so as to be secured to the globe 20. Two folded portions 73 are formed in the lengthwise direction of the band body 72. When the folded portions 73 are elastically deformed, the band body 72 is contracted. Thus, the band body 72 can be wound around the globe 20 so as to be secured to the globe 20.

As shown in FIG. 6, the slide plate 61 of the vertically-holding member 60 is formed into an annular shape having a base portion 62 which matches the base 52 of the base plate 51. Four tag shape holding members 64 in the form of leaf springs arranged to be stood erect by cutting are formed at the same intervals in the circumferential direction of the inner end of the base portion 62. The outer surface of the arc-tube holding band 71 wound around the globe 20 of the arc tube 10 and thus secured to, the globe 20 is held between the tag shape holding members 64. Moreover, the-tag shape holding members 64 are laser-welded to the arc-tube holding band 71 at a portion 65. Thus, the arc tube 10 is integrated with the slide plate 61 in such a manner that the electrically-discharge axis L of the arc tube 10 is perpendicular to a joining surface f3, namely a bottom surface of the base portion 62 of the slide plate 61, of the slide plate 61 with the base plate 51 and apart from the bottom surface f3 of the base portion 62 for a predetermined distance H1.

The arc tube 10 is secured to the vertically-holding member 60 by laser-welding the tag shape holding members 64 to the arc-tube holding band 71 wound and integrated to the globe 20 of the arc tube 10. Before the tag shape holding members 64 are welded to the arc-tube holding band 71, the arc tube 10 is able to freely slide in the axial direction along the holding portion or freely inclined around the holding portion. Moreover, the slid or inclined attitude is maintained when the arc tube 10 is slid or inclined, the attitude of the arc tube 10 can freely be changed.

Therefore, as shown in FIG. 12(*b*), the arc tube 10 is inclined to a predetermined position at which the electrically-discharge axis L is made to be in parallel to the vertical reference axis L1, which is a reference axis perpendicular to the bottom surface f3 of the slide plate 61 which is a surface of the slide plate 61 for joining to the base plate 51, of the slide plate 61. Moreover, the arc tube 10 is slid in the axial direction until the leading end of the electrode 15*b* is brought to a position of height H1 from the bottom surface f3 of the slide plate 61. Then, the tag shape holding members 64 are secured to the arc-tube holding band 71 by laser welding at the foregoing predetermined position. Thus, the electrically-discharge axis L can be made to be perpendicular to the slide plate 61. Moreover, the leading end of the electrode can be positioned to a predetermined position.

Then, the slide plate 61 of the vertically-holding member 60 integrally holding the arc tube 10 is, as indicated by an arrow shown in FIG. 12(*c*), slid along the base portion 52 of the base plate 51. When the electrically discharge axis L has coincided with the central axis L2, which is the central axis of the electric discharge lamp apparatus, of the focusing ring 34, the base portion 62 of the slide plate 61 is laser-welded to the base portion 52 of the base plate 51. Thus, the arc tube 10 is integrated with the insulating plug 30 through the vertically-holding member 60. Thus, the electrically-discharge axis L of the arc tube 10 is brought to a required position with respect to the focusing ring 34. Reference numeral 66 represents a portion which must be laser-welded.

A side end 74*a* of each of the tag shape members 74 of the arc-tube holding band 71 facing the slide plate 61 is cut into a tapered shape. When the inclination of the arc tube 10 is adjusted, the tag shape members 74 do not interfere with (the base portion 62) of the slide plate 61. That is, to vertically position the electrically-discharge axis L of the arc tube 10 with respect to the slide plate 61, the inclination of the arc tube 10 with respect to the arc tube 10 must be adjusted. When the inclination of the arc tube 10 is adjusted, there is apprehension that the tag shape members 74 of the holding band of outwards projecting over the arc tube 10 interfere with the slide plate 61. Since the side end 74*a* of the tag shape members 74 of the holding band facing the slide plate 61 is cut into the tapered shape, interference of the tag shape members 74 with the base portion 62 of the slide plate 61 can be prevented even if the arc tube 10 is greatly inclined, as shown in FIG. 12(*b*). Therefore, the inclination of the arc tube 10 can smoothly and accurately be adjusted.

A cylindrical outer tube portion 42 extending rearwards and a cylindrical boss 43 extending rearwards in the outer tube portion 42 are formed at the rear end of the insulating plug 30. The cylindrical belt-type terminal 44 for constituting a negative terminal of the lamp-side connector C2 is integrally secured to the outer surface of the base portion of the outer tube portion 42. Moreover, a cap-type terminal 47 serving as the positive terminal of the lamp-side connector is integrally fitted to the boss 43.

As shown in FIG. 10, the belt-type terminal 44 has a cylindrical shape having an outward flange 45. The belt-type terminal 44 is integrally formed with the insulating plug 30 by insertion molding with which injection molding is performed in a state in which the belt-type terminal 44 is inserted into a mold. The outward flange 45 is provided with a lead-support engaging hole 45*a* to which the rear end of the lead support 36, which has penetrated the insulating plug 30, is secured by laser welding. Moreover, three cut portions 45*b* arranged to position the belt-type terminal 44 with respect to the insulating plug 30 in the circumferential direction and formed at the same intervals in the circumferential direction of the outward flange 45 are provided for the outward flange 45.

As shown in FIG. 11, vertical ribs 43*a* extending in the axial direction are formed on the outer surface of the boss 43. In this embodiment, for instance, four vertical ribs 43*a* are formed at the same intervals in the circumferential direction of the boss 43. However, it is not limited to provide four ribs. Thus, the adhesive force of the cap-type terminal 47 fitted to the boss 43 can be enlarged so that separation of the cap-type terminal 47 is prevented.

In the insulating plug 30, a lead-wire engaging hole 48 is formed at the top end of the cap-type terminal 47, and a lead-wire insertion hole 43*b* is formed in the boss 43. A first tapered portion 80 which tapers from the opening 32 to the lead-wire insertion hole 43*b* is provided, for guiding a lead wire 18*b* to be inserted into the lead-wire insertion hole 43*b*. A second tapered portion 81 is fromed at the rear end of the lead-wire insertion hole 43*b*, for guiding the lead wire 18*b* to run thought the lead-wire insertion hole 43*b*. Accordingly, the lead wire 18*b* extending over the rear end of the arc tube 10 and allowed to pass through the opening 32 of the insulating plug 30 and the lead-wire insertion hole 43*b* with smoothly guiding the first tapered portion 80 and the second tapered portion 81 is engaged to the engaging hole 48 and laser-welded to the same.

The longitudinal length of the insulating plug 30 is 29.3 mm, the length of the focusing ring 34 from the contact reference plane f1 to the rear end of the insulating plug 30 is 24.9 mm and the length from the reference plane f1 to the leading end of the lead wire 18*a* is 55 mm. Thus, the electric discharge lamp apparatus has a very short overall length of 79.9 mm.

A process for securing the arc tube 10 to the insulating plug 30 will now be described with reference to FIGS. 12 to 14.

Initially, the holding band body 72 is wound around a-predetermined axial directional position of the globe 20 of the arc tube 10. Then, the tag shape members 74 allowed to abut against each other are spot-welded so that the arc-tube holding band 71 is wound and secured to the arc tube 10. Then, as shown in FIG. 12(*a*), the arc tube 10 is allowed to pass through the central hole of the slide plate 61. Thus, an assembled state in which the arc-tube holding band 71 is supported by the tag shape holding members 64 is realized. Then, as shown in FIG. 12(*b*), the slide plate 61 is secured to a jig 68. Thus, the arc tube 10 is supported in such a manner that slide adjustment of the arc tube 10 with respect to the slide plate 61 in the axial direction is permitted and the inclination can be adjusted.

Then, as shown in FIG. 13, CCD cameras (not shown) are used to observe the electrically-discharge axis L of the arc tube 10 from two horizontal axes, i.e. X-axis and Y-axis, perpendicular to the vertical reference axis L1, which is the central axis of the jig 68, of the slide plate 61. Then, the arc tube 10 is vertically slid or inclined with respect to the tag shape holding members 64 so that the position of the arc tube 10 is adjusted to an appropriate position.

FIG. 14 shows an image displayed on a display unit of the CCD camera with which the arc tube is observed from the direction X. On the screen of the display unit 80 of the CCD camera, a horizontal reference line LH is displayed which indicates an appropriate height of the leading end of the electrode 15*b* in the enclosed glass bulb 12. Moreover, a vertical reference line LZ indicating the vertical reference axis L1 of the slide plate 61 is displayed on the screen. While the screen of the display unit 80 is being observed, the arc tube 10 is vertically slid in such a manner that the leading end of the electrode 15*b* in the enclosed glass bulb 12 coincides with the horizontal reference line LH. Moreover, the arc tube 10 is inclined in such a manner that the electrically-discharge axis L is made to run parallel to the vertical reference line LZ. As described above, the position of the arc tube 10 with respect to (the tag shape holding members 64 of) the slide plate 61 is adjusted. At the appropriate position, the tag shape holding members 64 are laser-welded to the arc-tube holding band 71. Thus, the arc tube 10 is integrally secured to the slide plate 61.

Then, a jig (not shown) is used to secure and hold the insulating plug 30 in such a manner that the metal base plate 51 faces upwards. Moreover, as shown in FIG. 12(*c*), the vertically-holding member 60 of the slide plate 61 integrally holding the arc tube 10 is placed on the base portion 52 of the metal base plate 51 exposed to the front surface of the insulating plug 30. At this time, the lead wire 18*b* at the rear end of the arc tube 10 is allowed to pass through the lead-wire insertion hole 43*b*, and thus the lead wire 18*b* is engaged into the engaging hole 48 of the cap-type terminal 47.

Then, the vertically-holding member 60 of the slide plate 61 is slid along the base portion 52 of the metal base plate 51. At the position at which the electrically-discharge axis L has coincided with the central axis L2, which is the central axis of the electric discharge lamp apparatus, of the focusing ring 34, the slide plate 61 is integrally welded to the metal base plate 51. Thus, the arc tube 10 is integrated with the insulating plug 30 through the vertically-holding member 60. As a result, the electrically-discharge axis L of the arc tube 10 is brought to a required position with respect to the focusing ring 34.

That is, similarly to the position adjustment of the arc tube 10 with respect to the slide plate 61 which is performed as shown in FIGS. 13 and 14, the electrically-discharge axis L of the arc tube 10 is observed with CCD cameras from two horizontal axes (the X-axis and Y-axis) perpendicular to the central axis L2 of the focusing ring 34. The slide plate 61 is moved (slid) to a position at which the electrically-discharge axis L coincides with the vertical reference line displayed on the display unit of each CCD camera. At the foregoing position, the slide plate 61 is laser-welded to the metal base plate 51.

Then, the lead wire 18*b* at the rear end of the arc tube is laser-welded to the cap-type terminal 47. Then, the insulating sleeve 36*a* through which the lead support 36 is inserted is inserted into the lead-support insertion hole 35*a*. Then, the insertion end of the lead support 36 is engaged to the lead-support engaging hole 45*a* of the belt-type terminal 44, and then laser-welded to the lead-support engaging hole 45*a*. Then, the lead wire 18*a* at the leading end of the arc tube 10 is spot-welded to the leading end of the lead support 36. Thus, the arc tube 10 is integrally secured to the insulating plug 30.

As described above, the electric discharge lamp apparatus according to the present invention has the structure that the vertically-holding member which is holding the arc tube is moved along the base plate for a predetermined distance. Moreover, the vertically-holding member is integrally joined to the base plate. Therefore, the electrically-discharging axis of the arc tube can be moved to a required position at which the electrically-discharging axis coincides with the central axis of the focusing ring. As a result, the arc tube can easily and accurately be positioned and secured to the insulating plug.

The structure is arranged such that the arc tube is slid and inclined with respect to the tag shape holding members so as to vertically position and secure the electrically-discharging axis of the arc tube with respect to the slide plate. Then, the slide plate which is holding the arc tube is moved along the base plate for a predetermined distance, after which the slide plate is integrally welded to the base plate. Therefore, the electrically-discharging axis of the arc tube can be moved to a required position at which the electrically-discharging axis coincides with the central axis of the focusing ring. As a result, the arc tube can easily and significantly accurately be positioned and secured to the insulating plug.

Further, the base plate to which the vertically-holding member is joined is firmly integrated with the insulating plug without separation and looseness. Therefore, the durability of the vertically-holding member can be improved.

Still further, the tag members do not interfere with the slide plate even if the arc tube is greatly inclined. Therefore, the arc tube can smoothly be positioned with respect to the slide plate.

Yet further, the belt-type terminal can be integrated with the insulating plug simultaneously with the process for molding, for example the injection molding process, the insulating plug. Therefore, the process for joining the belt-type terminal to the insulating plug can be omitted. Since the cut portion provided for the outward flange is used in positioning in the circumferential direction, the lead-support engaging hole can accurately be brought to the required position at which the lead support must be disposed. Therefore, insertion and welding of the lead support to the lead-support engaging hole can smoothly be performed.

Yet further, the cap-type terminal constituting the lamp-side connector and fitted to the cylindrical boss at the rear end of the insulating plug cannot easily be separated. As a result, the durability of the lamp-side connector can be improved.

What is claimed is:

1. An electric discharge lamp apparatus comprising:

an arc tube having a glass bulb, in which electrodes are opposite to each other, and an ultraviolet-ray shielding globe for surrounding and shielding the glass bulb;

an insulating plug having a focusing ring, wherein the insulating plug is made of synthetic resin;

a metal lead support forwardly extending over the insulating plug, for supporting a front end of the arc tube; and a metal support member secured to the insulating plug and arranged to support a portion of the arc tube adjacent to a rear end of the globe, wherein the metal support member includes, a metal base plate secured to the insulating plug and forming a reference plane running parallel to the focusing ring, and a vertically-holding member made of metal, joined integrally with the metal base plate and vertically holding an electrically-discharging axis of the arc tube with respect to the reference plane of the metal base plate.

2. The electric discharge lamp apparatus according to claim 1, wherein the vertically-holding member comprises:

an arc-tube holding band made of metal and wound around and secured to the globe of the arc tube; and a ring-shape and metal slide plate arranged to hold an outer surface of the arc-tube holding band, having a plurality of tag shape holding members arranged to be welded to the arc-tube holding band in the holding portion and integrally welded to the metal base plate, wherein the arc-tube holding band wound around and secured to the arc tube and the slide plate are integrated in such a manner that the electrically-discharge axis of the arc tube is perpendicular to a joining surface between the slide plate and the metal base plate.

3. The electric discharge lamp apparatus according to claim 1, wherein the metal base plate is integrally secured to the insulating plug by integral molding, and the metal base plate has a folded portion which is embedded in the insulating plug to serve as a separation stopper for preventing the metal base plate from separating from the insulating plug.

4. The electric discharge lamp apparatus according to claim 2, wherein the arc-tube holding band has rectangular tag members folded to have an S-shape cross sectional shape to face each other, the tag members allowed to abut against each other are welded to each other to fixedly wind the arc-tube holding band around the globe of the arc tube, and a side end of each of the tag members each facing the slide plate is cut into a tapered shape.

5. The electric discharge lamp apparatus according to claim 1, wherein the insulating plug includes:

a cylindrical outer tube extending rearwards at the rear end of the insulating plug;

a cylindrical boss formed in the outer tube and extending rearwards;

a belt-type terminal to which the lead support is welded, being secured to the outer tube, wherein the belt-type terminal is in the form of a cylindrical member having an outward flange provided with a lead-support insertion hole and a cut portion for locating the circumferential direction;

a cap-type terminal to which a lead wire extending from the rear end of the arc tube and allowed to penetrate the insulating plug is welded, being fitted to the boss, wherein the belt-type terminal is formed integrally with the insulating plug by insertion molding; and a lamp-side connector formed integrally with the rear end of the insulating plug, for connecting a connector for supplying electric power.

6. The electric discharge lamp apparatus according to claim 1, wherein the insulating plug comprises:

a cylindrical outer tube extending rearwards at the rear end of the insulating plug;

a cylindrical boss formed in the outer tube and extending rearwards at the rear end of the insulating plug;

a belt-type terminal to which the lead support is welded, being secured to the outer tube;

a cap-type terminal to which a lead wire extending from the rear end of the arc tube and allowed to penetrate said insulating plug is welded, being fitted to the boss;

a lamp-side connector formed integrally with the rear end of said insulating plug, for connecting a connector for supplying electric power; and a vertical rib for preventing separation of the fitted cap-type terminal is provided for the outer surface of the boss.

7. The electric discharge lamp apparatus according to claim 1, wherein the insulating plug comprises:

an opening for receiving the arc tube;

a lead-wire insertion hole;

a first tapered portion which tapers from the opening to the lead-wire insertion hole, for guiding a lead wire of the arc tube to be inserted into the lead-wire insertion hole.

8. The electric discharge lamp apparatus according to claim 7, wherein the insulating plug further comprises a second tapered portion formed at the rear end of the lead-wire insertion hole, for guiding the lead wire to run thought the lead-wire insertion hole.

9. The insulating plug according to claim 6, further comprising:

an opening for receiving an arc tube;

a lead-wire engaging hole formed at the cap-type terminal;

a lead-wire insertion hole formed in the cylidrical boss at a position corresponding to the lead-wire engaging hole;

a first tapered portion which tapers from the opening to the lead-wire insertion hole.

10. The insulating plug according to claim 9, further comprising:

a second tapered portion formed at the rear end of the lead-wire insertion hole.

11. The insulating plug according to claim 6, further comprising:

an opening for receiving an arc tube;

a lead-wire engaging hole formed at the cap-type terminal;

a lead-wire insertion hole formed in the cylindrical boss at a position corresponding to the lead-wire engaging hole;

a second tapered portion formed at the rear end of the lead-wire insertion hole.

12. The electric discharge lamp apparatus according to claim 1, wherein the insulating plug comprises:

a lead-wire insertion hole;

a second tapered portion formed at the rear end of the lead-wire insertion hole, for guiding a lead wire to run thought the lead-wire insertion hole.

13. An insulating plug for an electric discharge lamp apparatus, comprising:

an insulating plug body made of synthetic resin;

a metal base plate secured to the insulating plug body;

a cylindrical outer tube having an outer surface extending rearwards from a rear end of the insulating plug body;

a cylindrical boss formed in the outer tube and extending rearwards at the rear end of the insulating plug body;

a belt-type terminal secured to the outer surface of the cylindrical outer tube;

a cap-type terminal fitted to the cylindrical boss;

a lamp-side connector formed integrally with the rear end of said insulating plug, for connecting a connector for supplying electric power; and a vertical rib portion disposed on the outer surface of the cylindrical boss for preventing separation of the fitted cap-type terminal from the cylindrical boss.

14. The insulating plug according to claim 13, wherein the vertical rib portion includes four vertical ribs formed at the same intervals in the circumferential direction of the boss.

* * * * *

UNITED STATES PATENT AND TRADEMARK OFFICE

CERTIFICATE OF CORRECTION

PATENT NO. : 6,294,861 B1
DATED : September 25, 2001
INVENTOR(S) : Kunimasa Mochiduki, Masato Harazaki, Yasuyoshi Numajiri, Takeshi Fukuyo, Yoshitaka Ohshima and Shinichi Irisawa It is certified that error appears in the above-identified patent and that said Letters Patent is hereby corrected as shown below:

Title page, Item [54] and Column 1, line 1,
Delete "ELECTRIC DISCHARGE LAMP APPARATUS" and insert
-- ARC TUBE BASE WITH ALIGNABLE METAL SUPPORT MEMBER --.

Signed and Sealed this

Fourteenth Day of May, 2002

*Attest:*

*Attesting Officer*

JAMES E. ROGAN
*Director of the United States Patent and Trademark Office*